US005687540A

United States Patent [19]

Thomas

[11] Patent Number: 5,687,540

[45] Date of Patent: Nov. 18, 1997

[54] METHOD OF FINISHING WINDOW OPENINGS

[76] Inventor: Godfrey J. R. Thomas, 516-13th St. S., Lethbridge, Alberta, Canada, T1J 2W2

[21] Appl. No.: 517,459

[22] Filed: Aug. 21, 1995

Related U.S. Application Data

[63] Continuation of Ser. No. 206,720, Mar. 7, 1994, abandoned.

[51] Int. Cl.[6] ..... E06B 3/00

[52] U.S. Cl. ..... 52/745.15; 52/211; 49/504

[58] Field of Search ..... 52/107

[56] References Cited

U.S. PATENT DOCUMENTS

| | | | |
|---|---|---|---|
| 450,081 | 4/1891 | Mesker et al. | 52/211 |
| 451,877 | 5/1891 | Mesker et al. | 52/211 |
| 1,136,860 | 4/1915 | Bishop | 52/211 |
| 1,393,792 | 10/1921 | Knapp | 52/211 |
| 1,841,865 | 1/1932 | Whiting | 52/204.1 X |
| 2,166,870 | 7/1939 | Livesay | 52/204.1 X |
| 3,276,174 | 10/1966 | Cooney | 52/204.53 |
| 3,340,665 | 9/1967 | Kohl | 49/504 X |
| 3,465,485 | 9/1969 | Knipper | 52/204.5 |
| 3,835,586 | 9/1974 | Gates | 52/204.1 X |
| 4,328,644 | 5/1982 | Scott et al. | 49/504 X |
| 5,148,649 | 9/1992 | Cipriano | 49/504 X |

FOREIGN PATENT DOCUMENTS

| | | | |
|---|---|---|---|
| 703343 | 2/1965 | Canada | 52/107 |
| 78800 | 1/1955 | Denmark | 52/107 |
| 1268117 | 6/1961 | France . | |
| 1127568 | 4/1962 | Germany | 52/204.1 |
| 2731795 | 2/1979 | Germany | 52/204.1 |
| 0491025 | 4/1952 | Italy | 49/504 |
| 2336467 | 7/1973 | Netherlands . | |
| 35717 | 12/1905 | Switzerland | 52/204.1 |
| 0319612 | 4/1957 | Switzerland | 52/204.1 |
| 1174 | of 1895 | United Kingdom | 52/204.1 |
| 0672284 | 5/1952 | United Kingdom | 52/204.1 |

*Primary Examiner*—Carl D. Friedman
*Assistant Examiner*—Yvonne Horton-Richardson
*Attorney, Agent, or Firm*—George H. Dunsmuir

[57] ABSTRACT

A method of finishing window cavities is described. This includes the step of flaring peripheral surfaces which define a window opening outwardly from an exterior wall toward an interior wall. Window cavities finished in accordance with the teachings of this method create a sensation of spaciousness of light.

10 Claims, 5 Drawing Sheets

METHOD OF FINISHING WINDOW OPENINGS

This application is a continuation of Ser. No. 08/206,720, filed Mar. 7, 1994, now abandoned.

BACKGROUND OF THE INVENTION

Formerly the building codes of various jurisdictions across North America provided that basement walls could be constructed out of 8 inch thick concrete. In recent years those jurisdictions that experience cold temperatures in winter have tended to require that an additional 4 inch interior frost wall be built inside the concrete wall. This has resulted in basement walls which are at least 12 inches thick. This exacerbates an existing problem of lack of light in the basement.

An obvious solution to the problem would be to increase the size of the window cavities. However, the height of the basement window is dictated to a large extent by lot grading of land adjacent to the window. The height of a basement window cannot be increased without altering the grade immediately adjacent the window or installing in ground structures known as "window wells". The installation of window wells is generally considered undesirable as it creates several potential safety hazards. Persons playing in the yard run the risk of falling into the window wells. Persons endeavouring to exit from a basement window in the event of fire may be prevented from doing so by the size and location relative to the basement floor of the window well. In addition, windows with window wells are more apt to have problems relating to water seepage.

As the cost of residential lots and building materials increase, consumers are demanding that basements be developed in such a fashion that more use can be made of them. Walkout basements have become more popular, however, not all lots are suitable for a walkout basement. An impediment or limiting factor with respect to basement development remains the low level of light which entering the basement through the window cavities, which make the basements in many homes appear almost dungeon-like.

SUMMARY OF THE INVENTION

What is required is a method of finishing window cavities which will contribute in a positive way to developing a sensation of spaciousness and light.

According to the present invention there is provided a method of finishing window cavities which includes the step of flaring peripheral surfaces which define an opening outwardly from an exterior wall toward an interior wall.

Window cavities finished in accordance with the teachings of the method described above create a sensation of spaciousness of light. The operative angle for the cavities is flared at an overall angle of between 10 degrees and 70 degrees in relation to a notional plane perpendicular to the exterior wall. The preferred angle is 45 degrees.

The flaring creates an aesthetically appealing opening. There are a number of ways in which the flaring can be achieved, as will hereinafter be further described. One way is with straight angular surfaces. Another way is with curved surfaces, by making the peripheral surfaces either convex or concave. Another way is through a peripheral surfaces which is stepped.

The method has a number of secondary benefits. The flaring of a window opening provides better access from the interior of the basement to the window for escape in the event of fire. Should leakage occur between the window and its frame, water will run along the sloped peripheral surfaces and down the interior wall. This prevents a "pooling" of water within the window opening which can lead to water seepage into the walls. The presence of water in the walls results in mildew and the eventual rotting of building materials. The flaring of the window reduces the amount of dust and dirt that tends to accumulate in the window areas. The flaring of the window eliminates the need for casings around the window. Casings are normally completed in a high grade expensive wood; so the described window treatment saves materials expense and associated installation costs.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
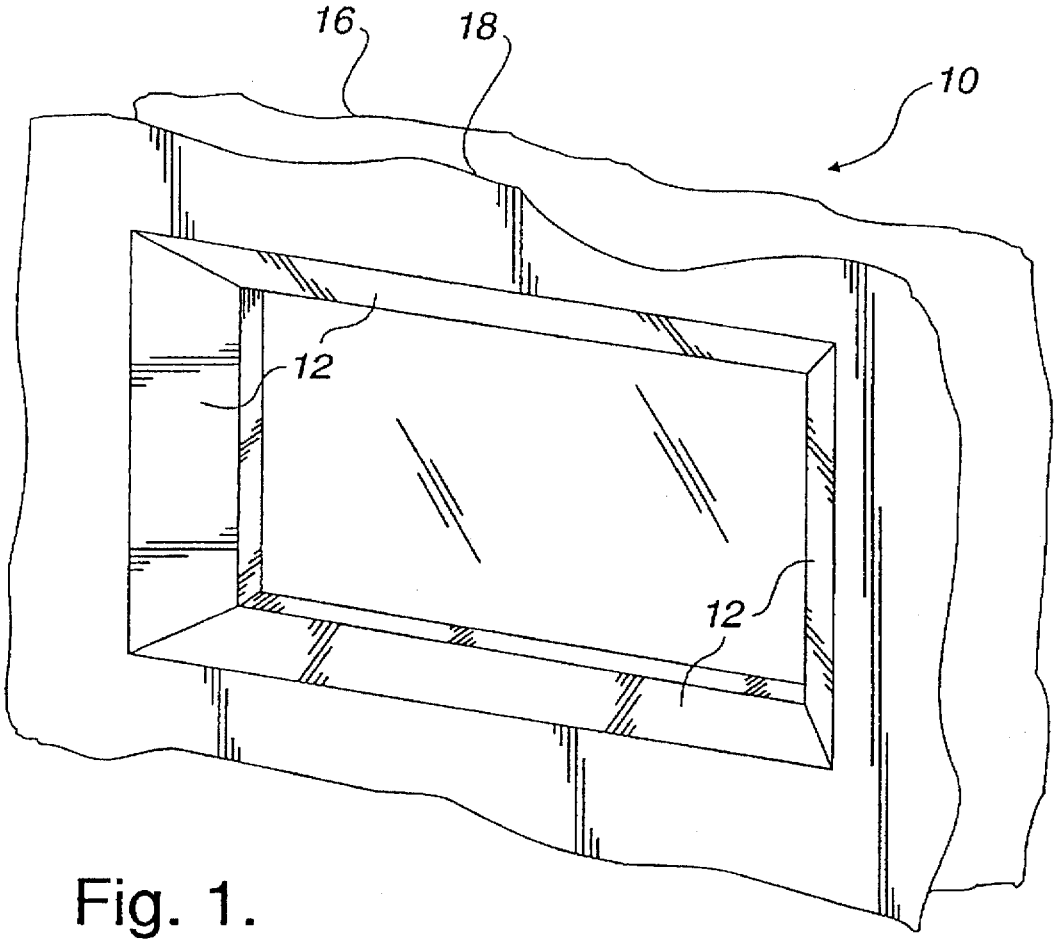
FIG. 1 is a perspective view of a window opening constructed in accordance with the teachings of the preferred method as hereinafter described.

The preferred method of finishing window cavities, generally identified by reference numeral 10 will now be described with reference to FIGS. 1 through 5.

The method includes the step of flaring peripheral surfaces 12 which define opening 10 outwardly from an exterior wall 16 toward an interior wall 18. The flaring is at angle in an overall operative range of between 10 degrees and 70 degrees in relation to a notional plane 14 perpendicular to exterior wall 16. The preferred angle, and the one illustrated in FIGS. 1 through 5, is 45 degrees.

Figure 2:
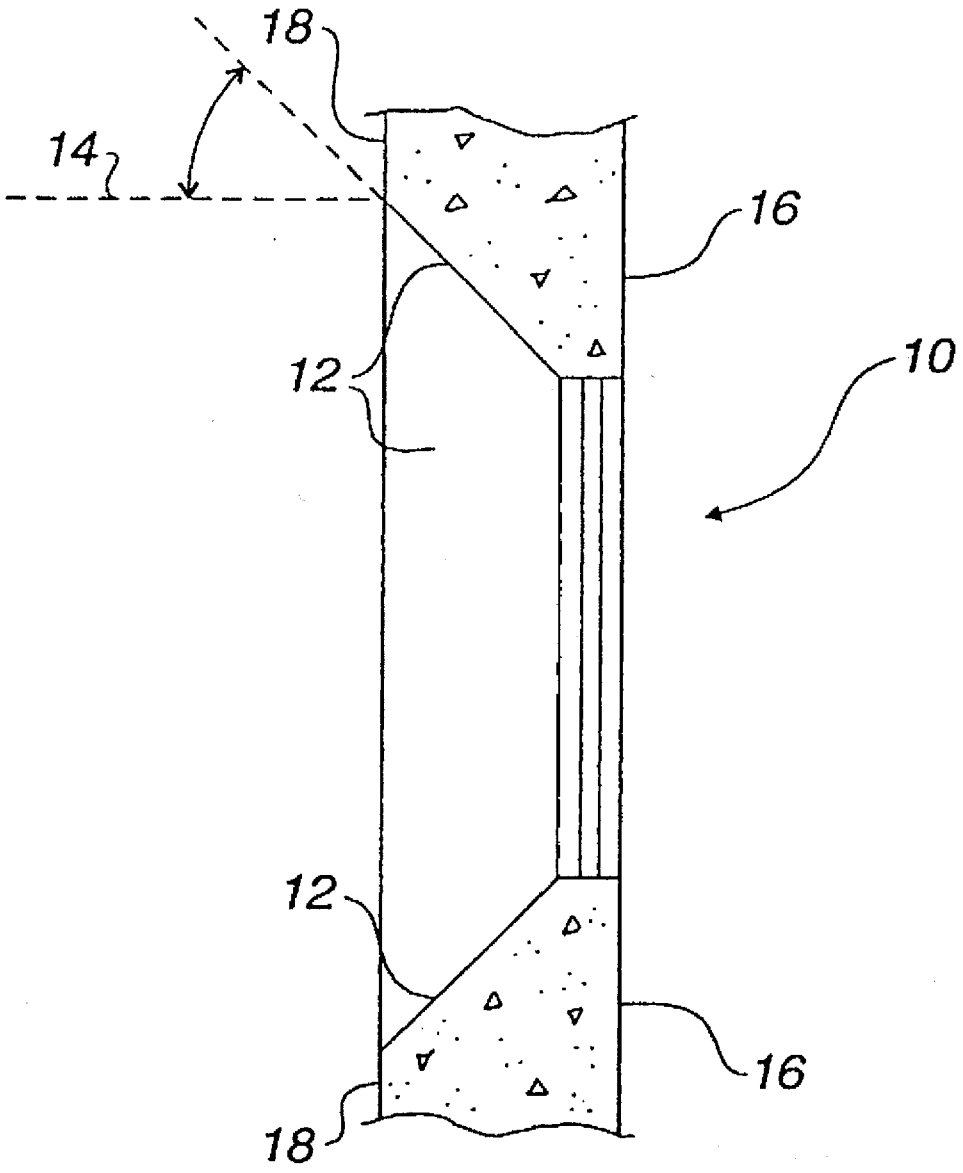
FIG. 2 is a side elevation view in section of the window opening illustrated in FIG. 1.
Figure 3:
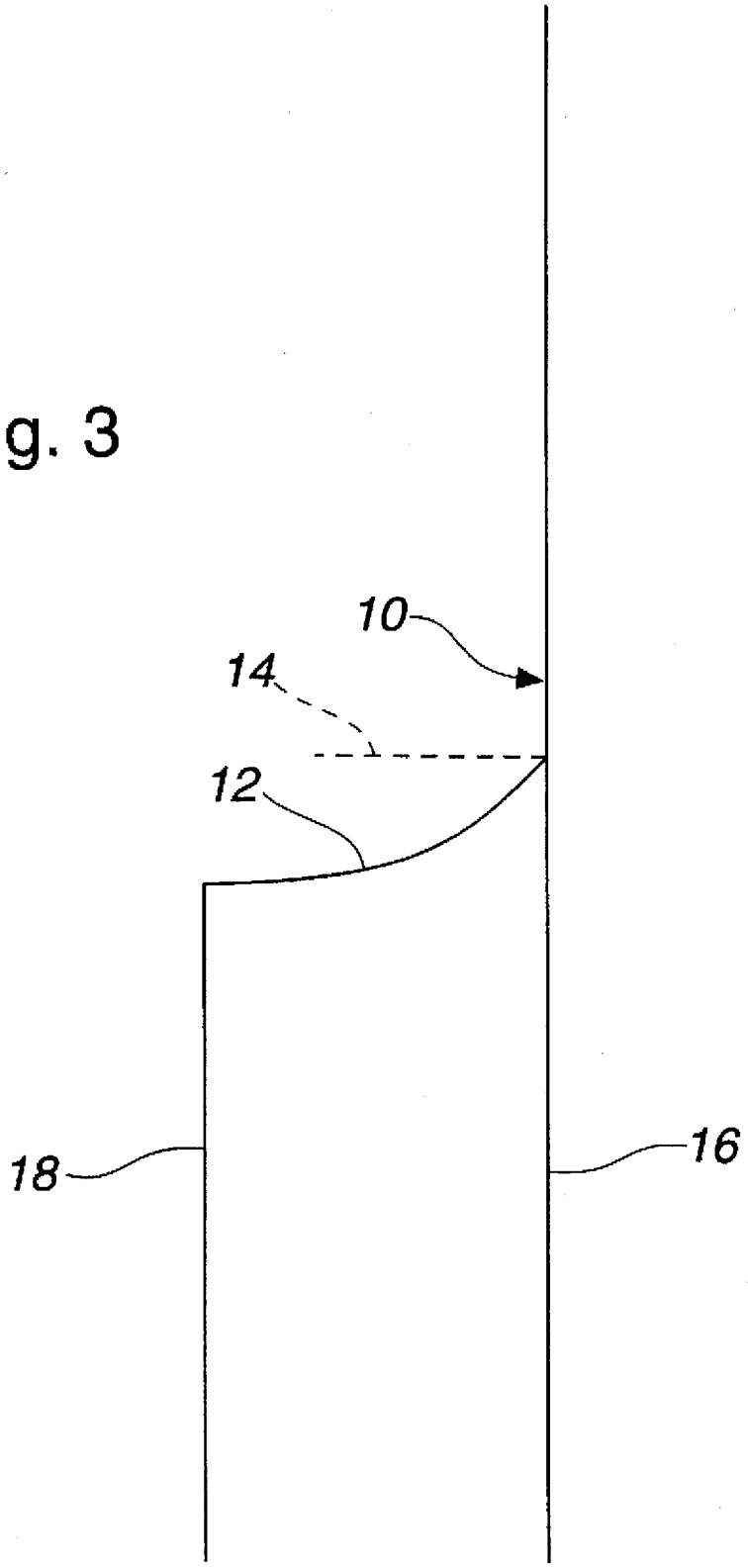
FIG. 3 is a side elevation view in section of a first alternate configuration of window opening.
Figure 4:
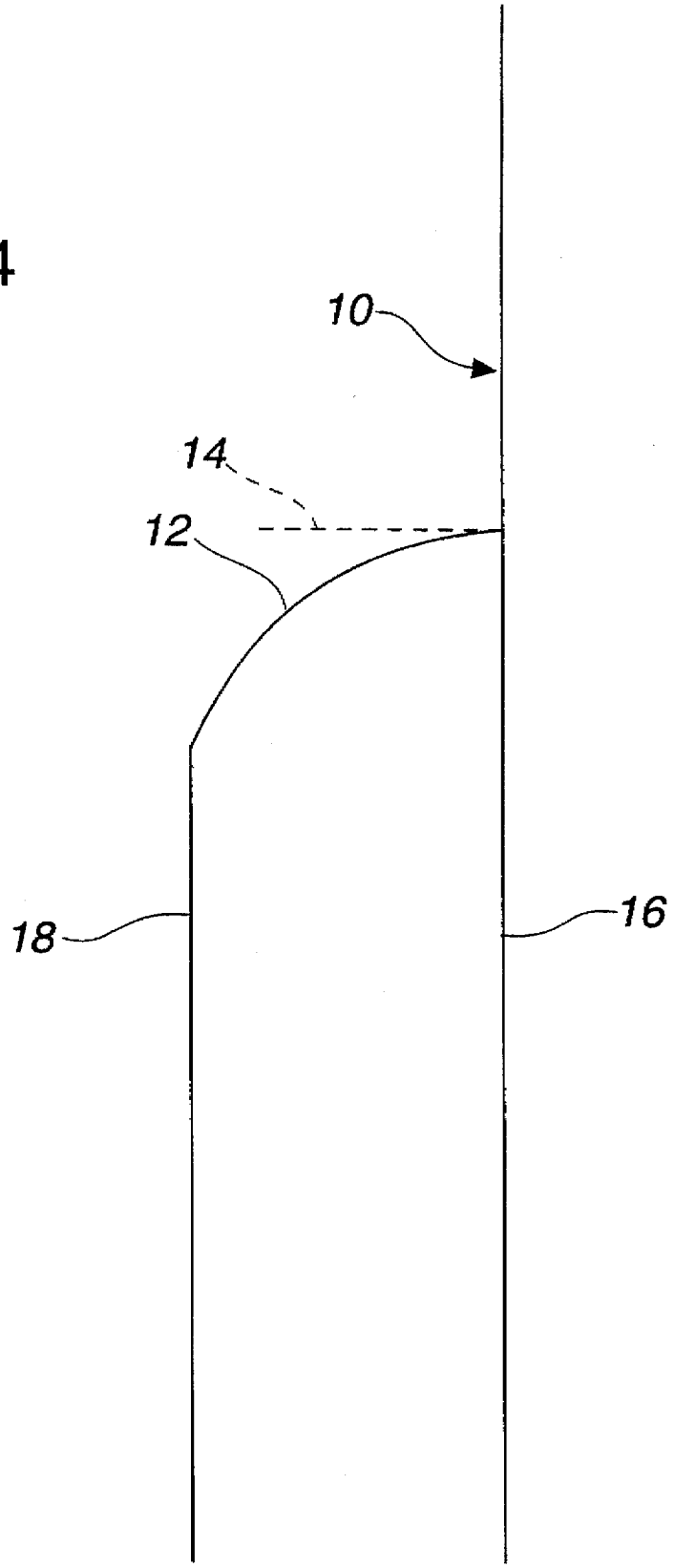
FIG. 4 is a side elevation view in section of a second alternate configuration of window opening.
Figure 5:
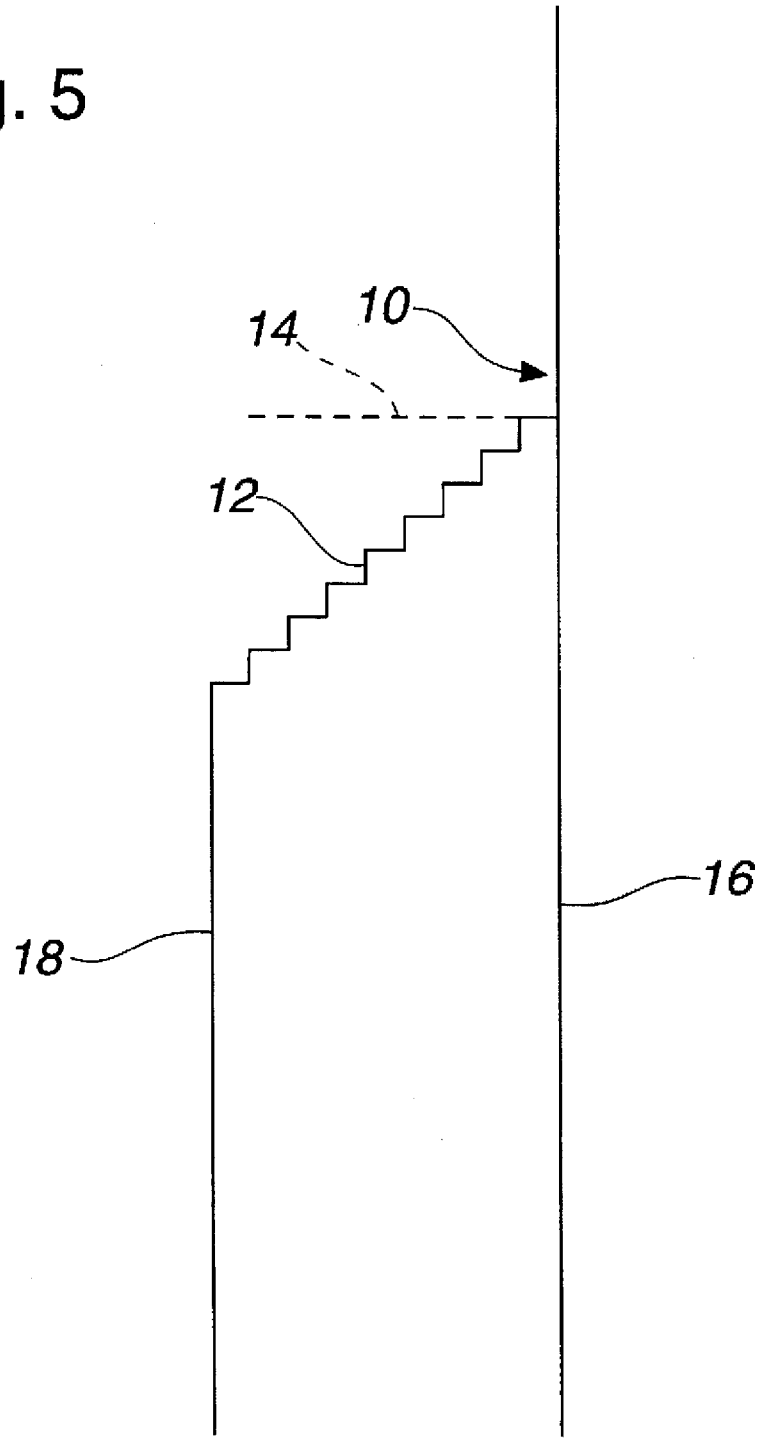
FIG. 5 is a side elevation view in section of a third alternate configuration of window opening.

FIGS. 2 through 5, are intended to illustrate a number of ways in which the flaring of window opening 10 can be achieved. In FIG. 2, peripheral surfaces 12 are straight surfaces angled at roughly 45 degrees. In FIG. 3 and 4, peripheral surfaces 12 are curved surfaces; concave and convex, respectively. In FIG. 5, peripheral surfaces 12 are stepped.

Window cavities finished in accordance with the teachings of the method described above are aesthetically pleasing and create a sensation of spaciousness of light. In existing basements, concrete can be chipped away from around the window opening and then the opening refinished in a flared fashion.

It will be apparent to one skilled in the art that modifications may be made to the illustrated embodiment without departing from the spirit and scope of the invention as defined by the Claims.

The embodiments of the invention in which an exclusive property or privilege is claimed are as follows:

1. A method for finishing window openings in walls having interior and exterior surfaces for increasing the amount of light admitted through a window unit mounted in said opening comprising providing an exterior wall having interior and exterior surfaces and having a window opening formed therein for receiving a window unit, modifying said window opening by removing wall material for flaring said wall adjacent said window opening from said window unit to said interior surface of said wall at an angle of between 10 degrees and 70 degrees with respect to a plane perpendicular to said wall, thereby providing increased light transmission through said window.

2. A method as in claim 1 and wherein said flaring step produces a substantially planar surface between said window unit and said interior surface.

3. A method as in claim 1 and wherein said flaring step produces a contoured surface between said window unit and said interior surface.

4. A method as in claim 3 and wherein said contoured surface is convex.

5. The method as defined in claim 1, wherein the preferred angle is 45 degrees.

6. The method as defined in claim 1, wherein the flaring is achieved by making the peripheral surfaces concave.

7. The method as defined in claim 1, wherein the flaring is achieved through a stepped contouring of the peripheral surfaces.

8. A method of finishing window cavities, comprising the step of:

convexly contouring the internal peripheral surfaces which define an opening such that the peripheral surfaces are flared outwardly from an exterior wall toward an interior wall, the flaring being an overall angle of between 10 degrees and 70 degrees relation to a notional plane perpendicular to the exterior wall.

9. A method of finishing window cavities, comprising the step of:

concavely contouring the internal peripheral surfaces which define an opening such that the peripheral surfaces are flared outwardly from an exterior wall toward an interior wall, the flaring being at an overall angle of between 10 degrees and 70 degrees in relation to a notional plane perpendicular to the exterior wall.

10. A method of finishing window cavities, comprising the step of:

contouring the internal surfaces which define an opening in a stepped manner such that the peripheral surfaces are flared outwardly from an exterior wall toward an interior wall, the flaring being at an overall angle of between 10 degrees and 70 degrees in relation to a notional plane perpendicular to the exterior wall.

* * * * *